United States Patent [19]

Kaplan

[11] 4,408,251

[45] Oct. 4, 1983

[54] TAMPER-RESISTANT SECURITY SYSTEM FOR AND METHOD OF OPERATING AND INSTALLING SAME

[75] Inventor: Irwin M. Kaplan, East Northport, N.Y.

[73] Assignee: Spectrum Four-Syte Corporation, Hauppauge, N.Y.

[21] Appl. No.: 282,945

[22] Filed: Jul. 13, 1981

[51] Int. Cl.[3] ..... E05B 49/00

[52] U.S. Cl. ..... 361/172; 307/10 AT; 340/543

[58] Field of Search ..... 361/171, 172, 188; 340/537, 542, 543; 307/10 AT

[56] References Cited

U.S. PATENT DOCUMENTS

| | | | |
|---|---|---|---|
| 2,894,197 | 7/1959 | Berry | 338/185 X |
| 3,633,167 | 1/1972 | Hedin | 361/172 X |
| 3,812,403 | 5/1974 | Gartner | 361/172 |
| 3,953,769 | 4/1976 | Sopko | 361/172 |
| 4,148,092 | 4/1979 | Martin | 361/172 |
| 4,209,709 | 6/1980 | Betton | 307/10 AT |

FOREIGN PATENT DOCUMENTS

| | | | |
|---|---|---|---|
| 2922262 | 12/1980 | Fed. Rep. of Germany | 361/172 |
| 720446 | 3/1980 | U.S.S.R. | 340/543 |

OTHER PUBLICATIONS

"Electronic Combination Locks" -Oakley, Wireless World 3/80 pp. 65-67.

"Using an EAROM-an Electronic Digital Locks" -Rash et al., Electronics Industry, 5/1980 p. 21.

*Primary Examiner*—Harry E. Moose, Jr.

*Attorney, Agent, or Firm*—Kirschstein, Kirschstein, Ottinger & Cobrin

[57] ABSTRACT

A tamper-resistant security system for and method of operating and installing the same are disclosed for electronically controlling an access device such as a garage door. A manual keyboard encoder mounted exteriorly on a garage door jamb is operative for generating coded electrical signals, including a predetermined sequence of coded electrical signals required to move the garage door from a closed to an open position. A control-processor unit mounted within the interior garage area is operative for detecting the coded signals, and for moving the garage door from the closed to the open position in response to detection of the predetermined coded signal sequence. A single pair of electrical conductors interconnects the encoder and the control-processor unit. The transmission of the predetermined coded signal sequence over the single pair of conductors deters intruders from compromising system security, and also simplifies the installation.

14 Claims, 5 Drawing Figures

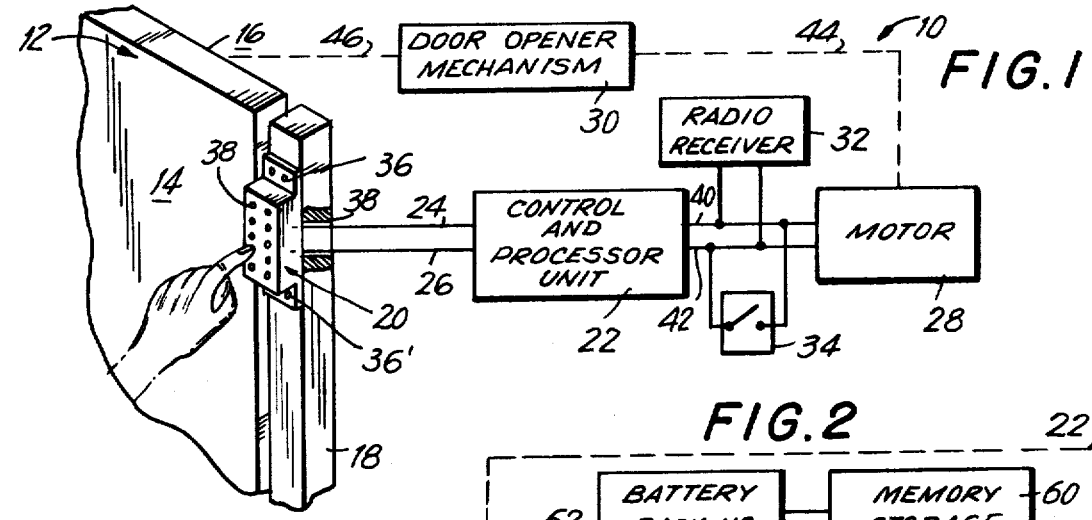
FIG. 1
FIG. 2
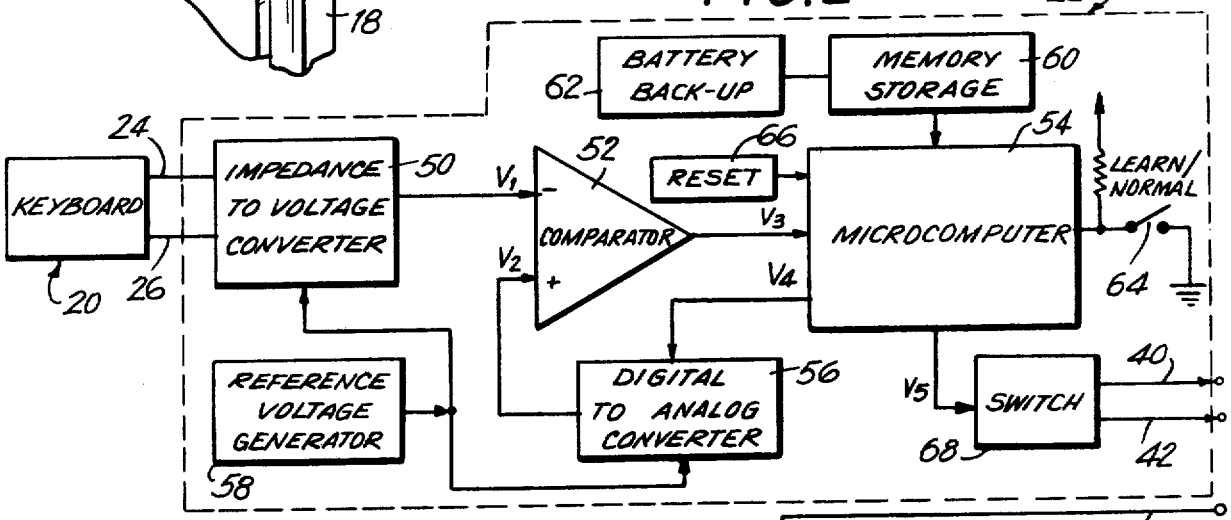
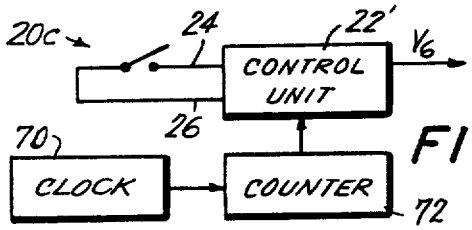
FIG. 5
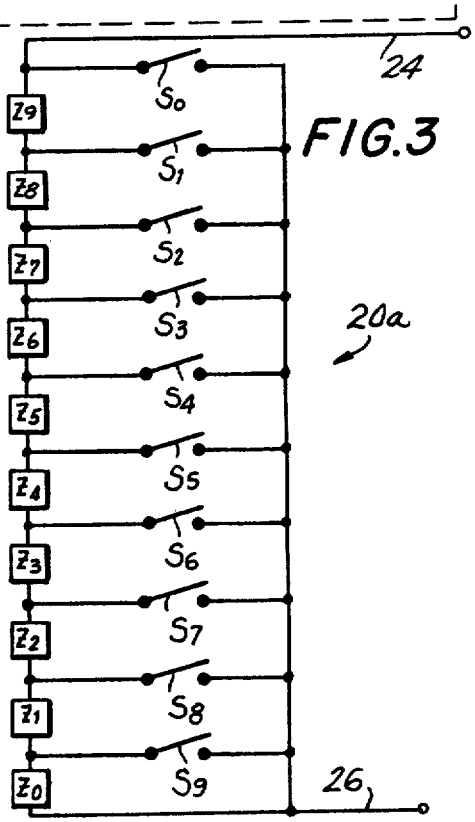
FIG. 3
FIG. 4
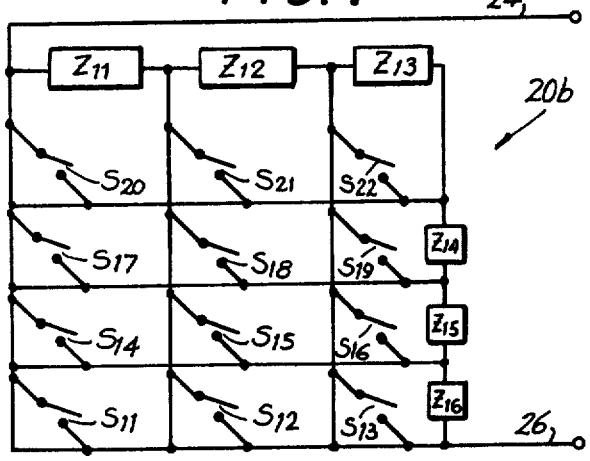

TAMPER-RESISTANT SECURITY SYSTEM FOR AND METHOD OF OPERATING AND INSTALLING SAME

BACKGROUND OF THE INVENTION

1. Field of the Invention

The present invention generally relates to a tamper-resistant security system for and method of controlling the operation of an access device and, more particularly, to a tamper-resistant electronically controlled garage door opener system and method of operating and installing the same.

2. Description of the Prior Art

Electronically controlled garage doors are typically opened or closed by radio signal commands coming from a remote control wireless transmitter located inside an automobile which an operator wishes to park in the garage, or from an interior push-button switch located at a convenient location inside the garage, or from an exterior key-operated switch located on the garage door jamb outside the garage. Due to the inconvenience for an operator to carry the key on his person, exterior keyless electronic locks, such as described in U.S. Pat. No. 3,978,376, have been proposed.

The known exterior key-operated switches and keyless electronic locks both operate by momentarily closing two electrical conductors or control wires which extend from the exterior key-operated switch or keyless lock, through the door jamb, and into the interior of the garage for connection to a conventional control-processor unit which, in turn, is connected to a motor drive and which, in turn, is connected to the electro-mechanical garage door opener mechanism itself. The momentary closing of the two control wires creates a short circuit condition which activates the opener mechanism to open the garage door.

However, the known exterior key-operated switches and keyless electronic locks are easily tampered with by an intruder who wishes to gain entry into the garage, but who has no key or does not know the lock combination. For example, both the key-operated switches and keyless locks can each be easily physically pulled from the garage door jamb, and thereupon, the intruder can easily short the two exposed control wires to open the garage door. As for the key-operated switches, they can also be overcome by merely picking the lock cylinder.

The aforementioned U.S. Pat. No. 3,978,376 is typical of those keyless electronic locks wherein the keyboard and the control-processor unit are both located exteriorly of the garage on the door jamb. As noted above, a serious shortcoming of this type of system is its susceptibility to physical force which would expose the two control wires. An intruder can easily pull the keyboard with its attached control-processor unit off the door jamb, and thereupon, short the exposed wires to activate the opener mechanism.

In order to overcome this lack of security, it has been proposed, e.g. in U.S. Pat. No. 3,633,167, to separate the keyboard from the control-processor unit. In this approach, the keyboard is mounted on the door jamb, and the control-processor unit is mounted behind the garage door within the interior garage area. However, this approach requires running approximately N+1 wires (where N equals the number of switches on the keyboard) from the keyboard located outside the door to the control-processor unit located inside the garage. In typical applications where there are ten switches on the keyboard, this would mean that approximately eleven wires must be separately connected to the keyboard, and thereupon, separately connected to the control-processor unit. Also, all of the eleven wires must be routed through a mounting hole formed in the door jamb. In sum, this multi-wire technique is both expensive and complicated to install. Retrofitting to an existing installation is also much more difficult.

SUMMARY OF THE INVENTION

1. Objects of the Invention

Accordingly, it is the general object of this invention to overcome the drawbacks of the prior art security systems.

It is a further object of this invention to provide a tamper-resistant security system which reliably prevents unauthorized intruder entry.

It is another object of this invention to deter an intruder from compromising system security by shorting or bridging the electrical wires or by otherwise tampering with the system.

It is still another object of this invention to provide a tamper-resistant security system which is easy to install even for a non-skilled person.

It is yet another object of this invention to eliminate the use of keys to operate the security system.

Still another object of this invention is to provide a method of easily converting existing installations of garage doors opener systems.

Yet another object of this invention is to provide a security system which does not require complete connectors or multiple wiring to install the system.

Another object of this invention is to provide a combination for opening the garage door, which combination is easily changeable by the operator to any other desired combination.

2. Features of the Invention

In keeping with these objects and others which will become apparent hereinafter, one feature of the invention resides, briefly stated, in a tamper-resistant security system for, and method of, controlling the operation of an access device having an exterior side facing a publicly accessible exterior area, and an opposite interior side facing a secured interior area. The system and method of this invention are operative for preventing system compromise and unauthorized intruder entry from the exterior area past the access device to the secured interior area. In a preferred embodiment, the access device is a garage door which is movable relative to an adjacent garage door jamb between a closed and an open position in which entry from the exterior area to the secured interior garage area is barred and permitted, respectively.

The security system comprises a manual encoding means, a control means, and electrical signal transmission means. The encoding means, e.g. a keyboard, is located solely in the exterior area, and preferably is mounted on the door jamb. The keyboard is operative for generating coded electrical signals, including a predetermined sequence of coded electrical signals required to move the garage door from the closed to the open position.

The control means, e.g. a control-processor unit, is located solely in the interior garage area and is operative for detecting the generation of the coded electrical signals, and for moving the garage door from the closed to the open position in response to detection of the predetermined coded signal sequence.

The transmission means is operative for conducting the coded electrical signals from the exterior area to the interior garage area, and is constituted solely by a pair of electrical conductors or wires which interconnect the keyboard and the control-processor unit.

In accordance with this invention, the transmission of the predetermined coded signal sequence over the pair of wires is the sole way of moving the garage door by operation of the keyboard. In other words, intruder access to any point along the pair of wires, and particularly to the connection between the keyboard and the wires in the exterior area, is the equivalent in terms of system security to intruder access to the keyboard. Put another way, from the intruder's point of view, it makes no difference whether he has access to the keyboard or to the control wires, because in either case, the only way to open the garage door from the keyboard is by transmitting the predetermined coded signal sequence over the wires. Hence, the intruder cannot compromise system security by pulling the keyboard off the door jamb, and thereupon, by shorting or bridging the exposed wires.

Another feature of this invention resides in the fact that the two conductors or wires, which may be interchangeably installed, are the only conductors which are routed through a mounting hole formed in the door jamb. No matter how many keys are mounted on the keyboard, the system of this invention only requires a single pair of wires to extend through the door jamb. This feature obviates the prior art requirement of providing multiple wiring schemes and complex connectors. This feature simplifies the retrofitting of existing installations and even allows a non-skilled handyman to easily install the system of this invention.

In a preferred embodiment, the keyboard generates a predetermined sequence of different impedance levels, and in another embodiment, the keyboard generates an impedance having a predetermined sequence of different time durations. The keyboard need only contain passive devices.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a partially broken-away and schematic view of tamper-resistant security system as used to control the operation of a garage door in accordance with this invention;

FIG. 2 is a block diagram schematic of the keyboard and control-processor unit of FIG. 1;

FIG. 3 is an electrical circuit diagram of a preferred embodiment of the keyboard of FIG. 1;

FIG. 4 is an electrical circuit diagram of another preferred embodiment of the keyboard of FIG. 1; and FIG. 5 is a block diagram of another preferred embodiment of the keyboard and control-processor unit of FIG. 1.

DETAILED DESCRIPTION OF THE PREFERRED EMBODIMENTS

Referring now to the drawings, FIG. 1 shows a tamper-resistant security system 10 operative for controlling the operation of an access device 12 having an exterior side 14 facing a publicly accessible exterior area, and an opposite interior side 16 facing a secured interior area. In a preferred embodiment, the access device 12 is a movable garage door mounted on a building structure for movement relative to an adjacent garage door jamb 18 between a closed position and an open position in which entry from the exterior area past the garage door 12 to the secured interior garage area is barred and permitted, respectively. This invention has been described and illustrated in the context of an electrical garage door opener system merely for the purposes of ease of explanation and illustration. It will be expressly understood that the system and method of this invention are not intended to be limited solely to garage door opener systems, and that this invention can be used to control the operation of any door, such as a household or automobile or safe door, or any type of alarm system, or window, or an access device of any kind, which guards a controlled area for which access to and/or exit from the same is desired.

Hence, the movable garage door 12 shown in FIG. 1 has an exterior side wall 14 that faces a publicly accessible exterior area such as the street, and an opposite interior side wall 16 that faces a secured interior garage area in which an automobile or the like is to be parked and locked therein. The garage door 12 is typically framed by an adjacent door jamb 18, but it will be expressly understood that the term "jamb" as used throughout the specification and the claims is intended to mean any stationary part of the building structure, on which the garage door is mounted, or any part associated with said structure.

The system 10 of FIG. 1 comprises a manual encoding means or keyboard 20; a control means or control-processor unit 22; an electrical signal transmission means constituted of a single pair of interchangeable electrical conductors or control wires 24, 26; a motor drive 28; an electro-mechanical door opener mechanism 30; an optional radio receiver 32; and an optional interior push-button switch 34.

As best shown in FIG. 1, the keyboard 20 is exteriorly mounted on the door jamb 18 by fasteners 36, 36' and is located solely in the publicly accessible exterior area. The keyboard 20 is an N-switch keyboard, where N is equal to or greater than one. The switch 38 is a representative manually-operated push-button switch of the momentary action type. Upon manual depression of the switches, the keyboard is operative for generating coded electrical signals. In a preferred embodiment, the garage door 12 will be opened only when the operator depresses a predetermined combination of switches, i.e. when a predetermined sequence of coded electrical signals is generated from the keyboard. The operation of the keyboard is described in further detail below in connection with FIGS. 3, 4 and 5.

Turning now to the overall system installation, one pair of ends of the control wires 24, 26 is connected to the keyboard 20, and the opposite pair of ends of the control wires 24, 26 is connected to the control-processor unit 22, which is located solely in the interior garage area at some convenient location therein. Due to the mounting of the keyboard 20 in the exterior area, and the mounting of the control-processor unit 22 in the interior area, the two interchangeable control wires 24, 26 are preferably routed through a mounting hole 38, which is formed in, and extends through, the jamb 18. As will be further discussed below, the number of control wires in the hole 38 does not depend on the number of switches, and the two control wires are the only wires in the mounting hole 38.

The control-processor unit 22 is operative for detecting the generation of the coded electrical signals generated by depression of the switches on the keyboard, and for generating an output control signal over the output conductors 40, 42 when the actual electrical coded signals generated by the keyboard match the predetermined coded signal sequence required to open and/or close the door. The output control signal is conducted by the output conductors 40, 42 to the motor 28 which, in turn, is energized to activate the door opener mechanism 30 along the line of action 44. The opener mechanism 30 is operatively connected to the garage door 12 along line of action 46 to open and/or close the same. The motor 28 and opener mechanism 30 are entirely conventional, and form no essential part of this invention. Hence, a detailed description of the motor and opener mechanism are not believed to be necessary, and have been omitted for the sake of brevity.

The optional radio receiver 32 is connected in parallel across the output conductors 40, 42. The receiver 32 is conventional, and is operative for generating a command signal, analogous to the aforementioned output control signal, which is conducted to the motor 28 to activate the mechanism 30 and, in turn, to open and/or close the door 12 upon the detection of an appropriate radio signal from a non-illustrated wireless radio transmitter. Such transmitters are typically either hand-held portable devices, or are generally located inside the automobile to be parked in the garage.

The optional interior push-button switch 34 is likewise connected in parallel across the output conductors 40, 42, and is operative for generating a command signal, likewise analogous to the aforementioned output control signal, for opening and/or closing the garage door. The interior switch 34 is typically mounted at some convenient location inside the interior garage area to permit someone therein to operate the garage door.

Turning now to FIG. 3, a keyboard circuit **20*a* is shown therein, which is operative for generating different impedance levels across control wires 24, 26. The keyboard 20*a*** comprises a plurality of ten series-connected impedances $Z_0$–$Z_9$ and a plurality of switches $S_0$–$S_9$ connected across the impedances as shown. For ease of analysis, it will be assumed that all the impedances are resistors, and that each resistor has a value of R ohms, except $Z_0$ which is 6R ohms.

In use, if no switch is depressed, then the output impedance across the control wires 24, 26 is the sum of all the impedances, i.e. 15R ohms. If switch $S_9$ is depressed, for example, then impedance $Z_0$ is shorted out, and the output impedance is 9R. If switch $S_8$ is instead depressed, then impedances $Z_0$ and $Z_1$ are both shorted out, and the output impedance is 8R. Analogously, the depression of switches $S_7$–$S_0$ will cause the output impedance to be 7R–zero ohms, respectively. In summary, the depression of each and any switch causes a different impedance level to be placed across the control wires 24, 26.

FIG. 4 shows a twelve-switch keyboard circuit **20*b* wherein the switches $S_{11}$–$S_{22}$ and impedances $Z_{11}$–$Z_{16}$ are arranged in a matrix as illustrated. FIG. 4 demonstrates that this invention is intended to include the fact that any number of switches and any number of impedances could be used to comprise the keyboard, and that the number of impedances need not correspond to the number of switches. The FIG. 4 arrangement is currently preferred over the FIG. 3** arrangement, because the matrix requires fewer impedances, and the keyboard is less costly to manufacture.

For ease of analysis of the FIG. 4 circuit, let it be assumed that $Z_{11}=Z_{12}=R$ ohms, and that $Z_{13}=Z_{14}=Z_{15}=Z_{16}=3R$ ohms. Using conventional circuit analysis, the following table sets forth the different output impedances that are generated for each switch depression:

| Depressed Key | Selected Impedances | Output Impedance |
|---|---|---|
| $S_{11}$ | None | Zero |
| $S_{12}$ | $Z_{11}$ | R |
| $S_{13}$ | $Z_{11} + Z_{12}$ | 2R |
| $S_{14}$ | $Z_{15}$ | 3R |
| $S_{15}$ | $Z_{11} + Z_{15}$ | 4R |
| $S_{16}$ | $Z_{11} + Z_{12} + Z_{15}$ | 5R |
| $S_{17}$ | $Z_{14} + Z_{15}$ | 6R |
| $S_{18}$ | $Z_{11} + Z_{14} + Z_{15}$ | 7R |
| $S_{19}$ | $Z_{11} + Z_{12} + Z_{14} + Z_{15}$ | 8R |
| $S_{20}$ | $Z_{13} + Z_{14} + Z_{15}$ | 9R |
| $S_{21}$ | $Z_{11} + Z_{13} + Z_{14} + Z_{15}$ | 10R |
| $S_{22}$ | $Z_{11} + Z_{12} + Z_{13} + Z_{14} + Z_{15}$ | 11R |
| None | $Z_{11} + Z_{12} + Z_{13} + Z_{14} + Z_{15} + Z_{16}$ | 14R |

Hence, here again, the manual depression of any particular switch causes a different impedance level to be placed across the control wires 24, 26.

It will be understood that the keyboard generation of coded signals is not intended to be limited solely to generating different resistance levels. For example, the switched impedances can be real or complex, and can consist of resistors, inductors or capacitors, or any combination thereof. A plurality of voltage references, e.g. zener diodes, or current references, e.g. constant current sources, could also be used in place of the impedances.

Still another technique of generating coded signals is to generate a sequence of different time durations for a single impedance. In a preferred embodiment shown in FIG. 5, the N-switch keyboard **20*c* constitutes a single switch (N=1), so that the impedance presented across the control wires 24, 26 is either a short circuit or an open circuit. For this case, encoding is provided by manually varying the duration of the switch closure. In order to open and/or close the opener mechanism, a typical predetermined coded signal sequence could be "long, short, long." There are many ways that the control-processor unit 22' can recognize this predetermined switch closure sequence in order to operate the opener mechanism. For example, a typical predetermined time duration for a "short" closure could be defined as being greater than 10 milliseconds and less than 500 milliseconds. A "long" closure would then be defined as being a time duration greater than 500 milliseconds. The FIG. 5** system has the advantage of requiring only one inexpensive switch like an ordinary doorbell-type switch, and can be activated by touch without the operator having to see the keyboard. This is particularly advantageous at night, or when used by blind persons.

The circuit arrangement of the control-processor unit 22 shown in FIG. 2 is operative for detecting the different impedance levels generated by keyboard 20a or 20b, and for moving the garage door when the actual impedance sequence matches the predetermined sequence of impedance levels required to generate the output control signal required to more the door. The impedance sequence is conducted over control wires 24, 26 to an impedance-to-voltage converter 50 which is preferably an operational amplifier.

The impedance-to-voltage converter 50 converts the different input impedances to different analog voltage signals $V_1$ which are, in turn, conducted to the negative input terminal of the voltage comparator 52. The comparator 52 generates a digital signal $V_3$ which is conducted to a microcomputer or controller 54. As described in further detail below, one function of the controller 54 is to generate an N-bit digital output signal $V_4$ which is conducted to a digital-to-analog converter 56. The converter 56 is operative to generate an analog signal $V_2$ which is conducted to the positive input terminal of the comparator 52. In a preferred embodiment, the comparator 52 is operative to generate the digital signal $V_3$ to have a low state (logic 0) when $V_1 \geqq V_2$ and to generate a high state (logic 1) when $V_1 < V_2$. A reference voltage generator or scaling amplifier 58 is connected to both converters 50 and 56, and is operative to scale the analog voltages $V_1$ and $V_2$ to be proportional to each other.

The microcomputer 54 is preferably an INTEL 8748 chip, which includes a volatile memory storage 60 for storing the predetermined coded signal sequence required to operate the door. An auxiliary power back-up battery 62 is operatively connected to the memory 60, and is operative for permanently storing the predetermined coded signal sequence in the memory in the event of a main power failure in the system. A learn/-normal switch 64 cooperates with the controller 54 for changing the predetermined coded signal sequence to be stored in the memory 60. The controller 54 also includes automatic reset means 66 for setting a predetermined time interval for the predetermined coded signal sequence to be processed by the controller 54, and thereupon, for restarting the predetermined time interval in the event that the actual coded signals do not match the stored predetermined coded signal sequence during said time interval. When the actual coded signals match the stored predetermined coded signal sequence stored in the memory 60, then the controller 54 generates the aforementioned digital output control signal $V_5$. The output control signal $V_5$ is conducted to an electronic switch 68 which, in response to detection of the signal $V_5$, generates an analog signal which is conducted over output conductors 40, 42 for transmission to the motor 28 to energize the same, as described above.

Prior to describing the operation of the control-processor unit 22 in detail, the following assumptions will be made for the sake of simplifying the description. It will be initially assumed that the learn/normal switch 64 is in the closed or normal mode, and that a predetermined coded signal sequence has already been stored in memory 60. It will be further assumed that the predetermined sequence is a four digit combination, and that this combination corresponds to the sequential depression of the switches $S_6$, $S_9$, $S_4$, and $S_7$ on the keyboard 20a. It will be understood, of course, that any combination of switches could have been selected. Hence, as described above, the output impedance for depressed switches $S_6$, $S_9$, $S_4$, and $S_7$ will be 6 ohms, 9 ohms, 4 ohms, and 7 ohms, respectively. It will further be assumed that the converter 50 linearly converts in one-to-one relation from ohms to voltage, so that the comparator input signal $V_1$ will be 6 volts, 9 volts, 4 volts, and 7 volts, respectively.

In operation, before any switch is depressed, the output impedance of 15R supplied to the converter 50 causes $V_1$ to be set at about 15 volts, i.e. at a voltage value higher than for any switch depression. It will be noted that $V_1$ will range from 0 volts–10 volts in one-volt increments for any given switch depression. If no switch is depressed, then $V_1$ will be 15 volts. Also, before any switch is depressed, the controller 54 generates $V_4$ such that $V_2$ is set at about 12 volts, i.e. at a voltage value higher than for any switch depression, but lower than a non-switch depression. Since $V_1$ (15 v) $\geqq V_2$ (12 v), then $V_3$ is set at the low state. The controller 54 maintains the low state, and interprets this to mean that no key has as yet been depressed.

Now, let us assume that the keyboard operator has first depressed $S_6$, i.e. the correct first switch in the predetermined combination which is required to open the garage door. Concomitantly, the converter 50 sets $V_1$ to 6 volts. Since $V_1$ (6 v) $< V_2$ (12 v), then $V_3$ is set at the high state, and the controller 54 interprets this to mean that a switch has been depressed. Now the controller searches for the identity of the depressed switch. To save time, the controller initially sets $V_2$ to 6 volts, since it knows from its stored memory that this is the expected value. Since $V_1$ (6 v) $\geqq V_2$ (6 v), then $V_3$ is set at a low state. At this point, the controller knows that the depressed switch could be $S_6$, or $S_7$, or $S_8$, or $S_9$. Hence, to narrow the field, the computer thereupon increases $V_2$ to 7 volts. Since $V_1$ (6 v) $\geqq V_2$ (7 v), then $V_3$ is at the high state, and the controller interprets this to mean that the depressed switch was not $S_7$, or $S_8$, or $S_9$. Hence, the controller now knows that the depressed key was $S_6$.

Thereupon, the depressed switch $S_6$ is compared with the first digit of the combination of the predetermined coded signal sequence stored in the memory 60. Since this is a match, the reset 66 does not automatically reset the control-processor unit 22, but waits for $S_6$ to be released, so as to receive the signal for the next depressed switch. The controller now sets $V_2$ back to 12 volts. When $S_6$ is released, $V_1$ is reset to 15 volts. Since $V_1$ (15 v) $\geqq V_2$ (12 v), then $V_3$ is set at the low state, and the controller interprets this to mean that the first depressed switch S6 was released.

If switches $S_9$, $S_4$, and $S_7$ were now sequentially depressed, then the aforementioned steps would repeat in analogous manner, with the result that when the last match was made, the controller would generate the digital output control signal $V_5$ to actuate the electronic switch 68.

However, for the sake of completeness of description, let it be assumed that an error was made, and that the second switch depressed was not $S_9$, but was $S_8$. Hence, as noted above, prior to depressing the incorrect switch $S_8$, $V_1$ is reset to 15 volts, and $V_2$ is reset to 12 volts, so that $V_3$ is at the low state. Then, the depression of $S_8$ will cause $V_1$ to be set at 8 volts, and $V_1$ (8 v) $< V_2$ (12 v), so that $V_3$ is set at the high state. The controller 54 interprets this to mean that a switch has been depressed, and now proceeds to search for it. As before, the controller now initially sets $V_2$ at 9 volts, since it knows from its memory that this is the correct value it should expect to see. However, since $V_1$(8 v) $< V_2$ (9 v), then $V_3$ is still set at the high state. The controller now knows that one of the switches $S_0$–$S_8$ was depressed. There is no need for the controller to step down the signal $V_2$ to discover which one of the switches $S_0$–$S_8$ was depressed. The controller knows that the second depressed switch was not $S_9$, that an error has been made, and that there is no need to conduct any further search. Hence, the reset 66 automatically resets the control-processor unit.

Let it further be assumed that the keyboard operator correctly depressed $S_9$ as the second depressed switch, so that the controller is now awaiting the depression of the third correct switch, i.e. $S_4$, but that the operator now incorrectly depressed $S_5$. The analysis would now be as follows. Again, $V_1$ is reset to 15 volts, $V_2$ is reset to 12 volts, and $V_3$ is reset to the low state. The depression of $S_5$ causes $V_1$ (5 v) $<$ $V_2$ (12 v), so that $V_3$ is set at the high state, and the controller interprets this to mean that a switch has been depressed. The controller now checks whether it was indeed $S_4$ by setting $V_2$ at 4 volts. Since $V_1$ (5 v) $\geqq$ $V_2$ (4 v), then $V_3$ is set at the low state, and the controller interprets this to mean that the depressed switch could have been the correct switch $S_4$, or any of the incorrect switches $S_5$–$S_9$. The controller thereupon increases $V_2$ by one volt to 5 volts. Now, $V_1$ (5 v) $\geqq$ $V_2$(5 v), so that $V_3$ remains at the low state. The controller interprets this lack of change in the state of $V_3$ to mean that the depressed switch could only be one of the incorrect switches $S_5$–$S_9$, and that an error was made. The reset 66 automatically resets the control-processor unit.

As mentioned above, the learn/normal switch 64 is operative for changing the switch combination to any desired sequence and any number of depressions. In general terms, if the operator wishes to change the existing combination, then the switch 64 is merely opened, and the new combination is punched in at the keyboard. Any number of switches in any combination thereof could be selected. Thereupon, the operator returns the switch 64 to its closed normal mode of operation. The controller 54 will then store the new combination in its memory 60.

In specific terms, let it be assumed that the new combination to be stored in memory is the sequential depression of switches $S_6$, $S_9$, $S_4$, and $S_7$. As before, $V_1$ is initially set at 15 volts, $V_2$ is initially set at 12 volts, and $V_3$ is initially set at the low state. When the keyboard operator initially depresses $S_6$, $V_1$ is set at 6 volts, and $V_1$ (6 v) $<$ $V_2$ (12 v), so that $V_3$ is set at the high state. The controller 54 interprets this to mean that a key was depressed.

In order to determine which key was depressed, the controller 54 initiates a search by sequentially increasing the value of $V_2$. Hence, $V_2$ is initially set at 0 volts, in which case, $V_1$ (6 v) $\geqq$ $V_2$ (0 v), so that $V_3$ is set at the low state. The controller now knows that the depressed switch could have been $S_0$. Then, $V_2$ is set at 1 volt, and in the same manner, the controller now knows that the depressed switch could have been $S_1$, but not $S_0$. Eventually, when $V_3$ is set at 7 volts, then $V_1$ (6 v) $<$ $V_2$ (7 v), so that $V_3$ is set at the high state. Now the controller knows that it was not $S_7$, and is programmed such that it knows that the depressed key was the previous one, i.e. $S_6$. Hence, $S_6$ is stored as the first switch of the new combination. Upon release of $S_6$, the controller resets and awaits the second depression. The process repeats until the operator has inputed the desired combination. When the switch 64 is closed, the controller knows that the operator has finished. Thus, any number of key depressions can be used. The process continues until the switch 64 is closed.

Turning finally to FIG. 5, it will be recalled that the control-processor unit 22' detects the time duration of the closure of the keyboard switch. In a preferred embodiment, a clock 70 is operative for generating pulses, e.g. a plurality of pulses per second, and a counter 72 is operative for counting said pulses. The clock 70 and counter 72 are both operatively connected to the control-processor unit 22'. The control-processor unit 22' controls the counter 72 so that the latter accumulates the number of pulses generated by the clock 70 only as long as the keyboard switch is depressed. The accumulation or count ends when the keyboard switch is opened. The count may then be compared with the predetermined count stored in memory. This process continues until all of the actual counts are matched with the predetermined count sequence stored in the memory of the control-processor unit 22'. When a match is made, the unit 22' generates an output control signal $V_6$ which is analogous to the aforementioned output control signal $V_5$.

Each individual count, i.e. a "long" or a "short", can be measured by the control-processor unit 22' by comparing the actual count to a predetermined time standard. For example, as noted above, a "short" count can range between 10–500 milliseconds, and a "long" count can be greater than 500 milliseconds.

However, in a preferred embodiment, rather than using a predetermined time standard, this invention proposes normalizing the various counts to an individual's reaction speed in view of the fact that the reaction times of various individuals are different.

Thus, let it be assumed that the predetermined coded time sequence consists of the following three counts: "long, short, long" and that the operator depressed the switch and generated counts of 100, 20, and 80 pulses, respectively. After the three switch depressions are completed, to normalize these counts, the control unit 22' will calculate the mean between the shortest and longest count in order to determine what is a long or a short count for that particular individual. In this case, the mean $=(100+20)/2=60$. Hence, a count greater than 60 pulses is a long count, and a count less than 60 pulses is a short count for this particular individual. For other individuals, the mean value will be different. In this case, since the correct time sequence was entered, and control unit 22' will generate the output control signal $V_6$ and, in turn, this will cause the garage door to open.

The count sequence to be stored in memory is learned in a similar manner to that described earlier in connection with the learn/normal switch 64, or can be input via switches.

If desired, a simpler coded signal sequence can be used to close the door as compared to the coded signal sequence required to open the door. This simpler code, for example, could only require one or two matches of the key depressions, as compared to the four matches discussed above in connection with FIGS. 3 and 4, or the three matches discussed above in connection with FIG. 5.

The transmission of a predetermined coded signal sequence over a two-wire line deters intruder interference, since he cannot compromise system security by gaining access to the two control wires. Only by depressing the correct switches within a defined time interval will the garage door be opened and/or closed. Breaking, shorting, or impressing external voltages or currents into the two-wire line will not activate the door. Inasmuch as only two control wires are necessary to transmit the coded signals no matter how many switches are located on the keyboard, the system can be easily retrofitted to any existing installation.

It will be understood that each of the elements described above, or two or more together, may also find a useful application in other types of constructions differing from the types described above.

While the invention has been illustrated and described as embodied in a tamper-resistant security system for and method of operating and installing same, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A tamper-resistant security system for electronically controlling the movement of a garage door which has an exterior side wall that faces a publicly accessible exterior area, and an interior side wall that faces a secured interior garage area, said garage door being movable relative to an adjacent garage door jamb between a closed and an open position in which entry from the exterior area to the interior garage area is barred and permitted, respectively, said security system comprising:

(a) manual encoding means mounted on the door jamb and being located solely in the exterior area, said encoding means being operative for generating coded electrical signals including a predetermined sequence of coded electrical timing signals required to move the garage door from the closed to the open position, each timing signal having a time duration indicative solely of each individual user's sense of timing;

(b) non-prompting control means located solely in the interior garage area and operative for detecting the generation of the coded electrical signals, and for moving the garage door from the closed to the open position in response to detection of the predetermined coded timing signal sequence; and (c) electrical signal transmission means for conducting the coded electrical signals from the exterior area to the interior garage area, said transmission means being constituted solely by a pair of electrical conductors extending between the exterior and interior areas and interconnecting the encoding means and the control means, whereby the transmission of the predetermined coded signal sequence over the pair of electrical conductors is the sole way of moving the garage door by operation of the encoding means on the door jamb so that the intruder access to any point along the pair of electrical conductors, and particularly to the connection in the exterior area between the encoding means and the pair of electrical conductors, is the equivalent in terms of system security to intruder access to the encoding means, to thereby deter the intruder from compromising system security by shorting or bridging the pair of electrical conductors or otherwise tampering with the system.

2. A tamper-resistant, non-prompting, security system for controlling a device, comprising:

(a) user-operated manual encoding means for generating coded timing signals, each having a time duration indicative solely of each individual user's personal sense of timing;

(b) non-prompting control means operatively connected to the encoding means, for detecting the generation of the timing signals from any user, and for controlling the device upon detection of a predetermined sequence of time durations.

3. The security system as defined in claim 2, wherein the non-prompting control means includes means for normalizing each time duration to each user's personal sense of timing.

4. The security system as defined in claim 3, wherein the normalizing means includes means for determining the mean time between the shortest and the longest time duration, and means for determining whether the actual time durations are shorter or longer than the mean time.

5. The security system as defined in claim 2, wherein the manual encoding means includes an N-switch keyboard where N is equal to or greater than one, each switch being of the momentary-action type.

6. The security system as defined in claim 2, wherein the control means includes memory means for storing the predetermined coded signal sequence required to control the device, comparator means for comparing the actual coded electrical signals generated by the encoding means with the stored predetermined coded signal sequence, and processor means operatively connected to the memory means and the comparator means, for generating an output control signal when the actual coded electrical signals match the stored predetermined coded signal sequence, for controlling the operation of the device.

7. The security system as defined in claim 6, wherein the control means further includes auxiliary power back-up means operatively connected to the memory means, for permanently storing the predetermined coded signal sequence in the memory means in the event of main power system failure.

8. The security system as defined in claim 6, wherein the control means includes automatic reset means for setting a predetermined time interval for the predetermined coded signal sequence to be processed by the processor means, and for restarting the predetermined time interval in the event that the actual coded electrical signals do not match the stored predetermined coded signal sequence in said interval.

9. The security system as defined in claim 2, wherein the detector means includes means for normalizing each time duration to each user's sense of timing.

10. A tamper-resistant, code-changeable, security system for controlling a device, comprising:

(a) manual encoding means located in an accessible area, and operative for generating coded electrical signals of different time durations;

(b) control means located in a security area and operatively connected to the encoding means, said control means including detector means for detecting the generation of the coded electrical signals, and processor means for processing a predetermined time sequence of coded electrical signals to generate an output control signal for controlling the device upon detection of the predetermined time sequence, said control means including code changer means for enabling the predetermined sequence to be changed, and memory means for storing the changed predetermined sequence, said code changer means being operative for enabling the memory means to receive the changed predetermined sequence in response to convenient manual entry of the changed predetermined sequence at the encoding means in the accessible area; and (c) a pair of electrical conductors operative for conducting the predetermined time sequence to the control means.

11. The security system as defined in claim 10 for controlling the operation of an access device located between the accessible and security areas, said access device being a controlled garage door operably movable relative to an adjacent door jamb by the control means between an open and a closed position in which entry to the security area is permitted and barred, respectively; and wherein the encoding means is mounted on the door jamb; and further comprising a pair of electrical conductors extending between the accessible and security areas and interconnecting the encoding means and the control means for conducting the coded electrical signals to the latter; said pair of electrical conductors extending through a hole formed in the door jamb, and being interchangeable, and being the only conductors in said hole for ease of installation.

12. The security system as defined in claim 10, wherein the code changer means is a learn/normal switch actuatable between a learn condition in which the control means is enabled to store any predetermined sequence in the memory means in response to manual entry of the predetermined sequence at the encoding means, and a normal condition in which the control means is enabled to control the device upon detection of the stored predetermined sequence.

13. A method of controlling a device, comprising the steps of:

(a) manually generating a coded electrical signals of different time durations;

(b) detecting the manual generation of the coded electrical signals;

(c) controlling the device upon detection of a predetermined sequence of coded electrical signals;

(d) enabling the predetermined sequence to be changed at the option of a user; and (e) changing the predetermined sequence substantially simultaneously with the manual generation of the coded electrical signals after the enabling step has been performed.

14. The method as defined in claim 13; and further comprising the step of normalizing the different time durations to each user's own sense of timing.

* * * * *